US007003902B2

(12) United States Patent
Chen et al.

(10) Patent No.: US 7,003,902 B2
(45) Date of Patent: Feb. 28, 2006

(54) SHOE HAVING A WRAPPING ENCLOSING A WELT STRIP

(75) Inventors: Eddie Chen, 9F, No. 201, Sec. 1, Taichung-Kang Rd., Taichung City (TW); Phoenix Hsu, Taichung (TW)

(73) Assignee: Eddie Chen, Taichung (TW)

( * ) Notice: Subject to any disclaimer, the term of this patent is extended or adjusted under 35 U.S.C. 154(b) by 174 days.

(21) Appl. No.: 10/640,093

(22) Filed: Aug. 12, 2003

(65) Prior Publication Data

US 2005/0034324 A1 Feb. 17, 2005

(51) Int. Cl.
*A43B 9/04* (2006.01)
*A43B 9/10* (2006.01)
*A43B 15/00* (2006.01)

(52) U.S. Cl. ..... 36/78; 36/7 R; 36/17 PW; 12/67 K; 12/146 W; 12/142 D

(58) Field of Classification Search ..... 36/78, 36/17 R, 17 A, 17 PW, 21; 12/67 C, 67 K, 12/146 W, 142 D
See application file for complete search history.

(56) References Cited

U.S. PATENT DOCUMENTS 541,999 A * 7/1895 Gifford ..... 36/17 R
1,086,877 A * 2/1914 White ..... 36/78
1,687,461 A * 10/1928 Lyon ..... 36/78
1,708,552 A * 4/1929 Poole ..... 36/78
2,004,447 A * 6/1935 Plummer ..... 36/78
2,011,958 A * 8/1935 Vizard ..... 36/17 R
2,011,959 A * 8/1935 Vizard ..... 12/146 W
2,272,373 A * 2/1942 Jayne ..... 12/142 D
2,299,516 A * 10/1942 Vizard ..... 12/146 W
6,484,420 B1 11/2002 Chi et al. ..... 36/12
6,757,990 B1 * 7/2004 Chi et al. ..... 36/21
6,834,408 B1 * 12/2004 Chen ..... 36/21

* cited by examiner

*Primary Examiner*—Anthony Stashick
(74) *Attorney, Agent, or Firm*—Ladas & Parry LLP

(57) ABSTRACT

A shoe includes a false welt member which extends along and is secured to a peripheral region of an outsole. The welt member includes an interior strip, a wrapping sheet enclosing the interior strip, and a sewing line extending along the wrapping sheet. An upper has a bottom open end secured to at least one of the outsole and the welt member. The wrapping sheet may be made of leather like the upper so that the shoe can present a harmonious and elegant appearance. The interior strip may include two or more strip sections having different stiffness properties so that the shoe can have sufficient flexibility and stiffness at respective front and heel regions.

15 Claims, 10 Drawing Sheets

SHOE HAVING A WRAPPING ENCLOSING A WELT STRIP

BACKGROUND OF THE INVENTION

1. Field of the Invention

The invention relates to a shoe, more particularly to a shoe having a false welt member.

2. Description of the Related Art

Referring to FIGS. 1 and 2, a typical false-welted shoe includes an outsole 1, a false welt 2, an upper 3 and an insole 4. The false welt 2 includes a welt member 201 and decorative stitch lines 202 provided along the welt member 201. The false welt 2 is adhered to the top face of the outsole 1 along the periphery of the outsole 1. The bottom end of the upper 3 is lasted and is bonded to the bottom side of the insole 4. After the lasted upper 3 is secured to the top of the outsole 1, it is surrounded by the false welt 2.

As the false welt 2 is used, the shoe as shown in FIGS. 1 and 2 has an outer appearance which resembles a welted shoe. However, since the welt strip 201 is generally injection molded, it can not be made from a leathery material which is the same as that of the upper 3. Therefore, the shoe does not have a harmonious look. In addition, the shape of the welt strip 201 is the same throughout the entire length thereof and the appearance thereof is monotonous. Moreover, since the flexibility or stiffness of the welt strip 201 is constant through out the length thereof, the shoe does not possess sufficient flexibility and stiffness respectively at front and rear heel regions thereof.

As shown in FIG. 3, a shoe produced by using an Opanka construction method includes an upper 5 which has a bottom end directly sewn to the periphery of an outsole 6. The shoe as such does not always require any insole to interconnect the upper 5 to the outsole 6 and thus exhibits good flexibility. However, in order to enable the upper 5 to be sewn to the outsole 6, the outsole 6 must be made of a stitchable material having a high tearing strength. Therefore, the material usable for making the outsole 6 is limited. While EVA and PU are used commonly in the shoe industry, only PU which has high strength is suitable for making the outsole 6. In addition, PU, despite its high strength, is heavy and is hydrolyzable with water.

SUMMARY OF THE INVENTION

An object of the present invention is to provide an improvement over the conventional false-welted shoes so as to overcome the above-mentioned drawbacks.

Accordingly, a shoe according to the present invention comprises: an outsole having a top face with a peripheral region; a welt member extending along and secured to the peripheral region, the welt member including an interior strip, a wrapping sheet enclosing the interior strip, and a sewing line extending along the wrapping sheet, the wrapping sheet being folded to form a lower part, an upper part extending over the lower part, and a fold part interconnecting the lower and upper parts, the interior strip being embraced by the lower and upper parts and the fold part, the lower and upper parts respectively having marginal parts which are opposite to the fold part and which abut against each other; and an upper having a bottom open end, the bottom open end of the upper being secured to at least one of the top face of the outsole and the welt member.

BRIEF DESCRIPTION OF THE DRAWINGS

Other features and advantages of the present invention will become apparent in the following detailed description of the preferred embodiments with reference to the accompanying drawings, of which.

DETAILED DESCRIPTION OF THE PREFERRED EMBODIMENTS

Figure 1:
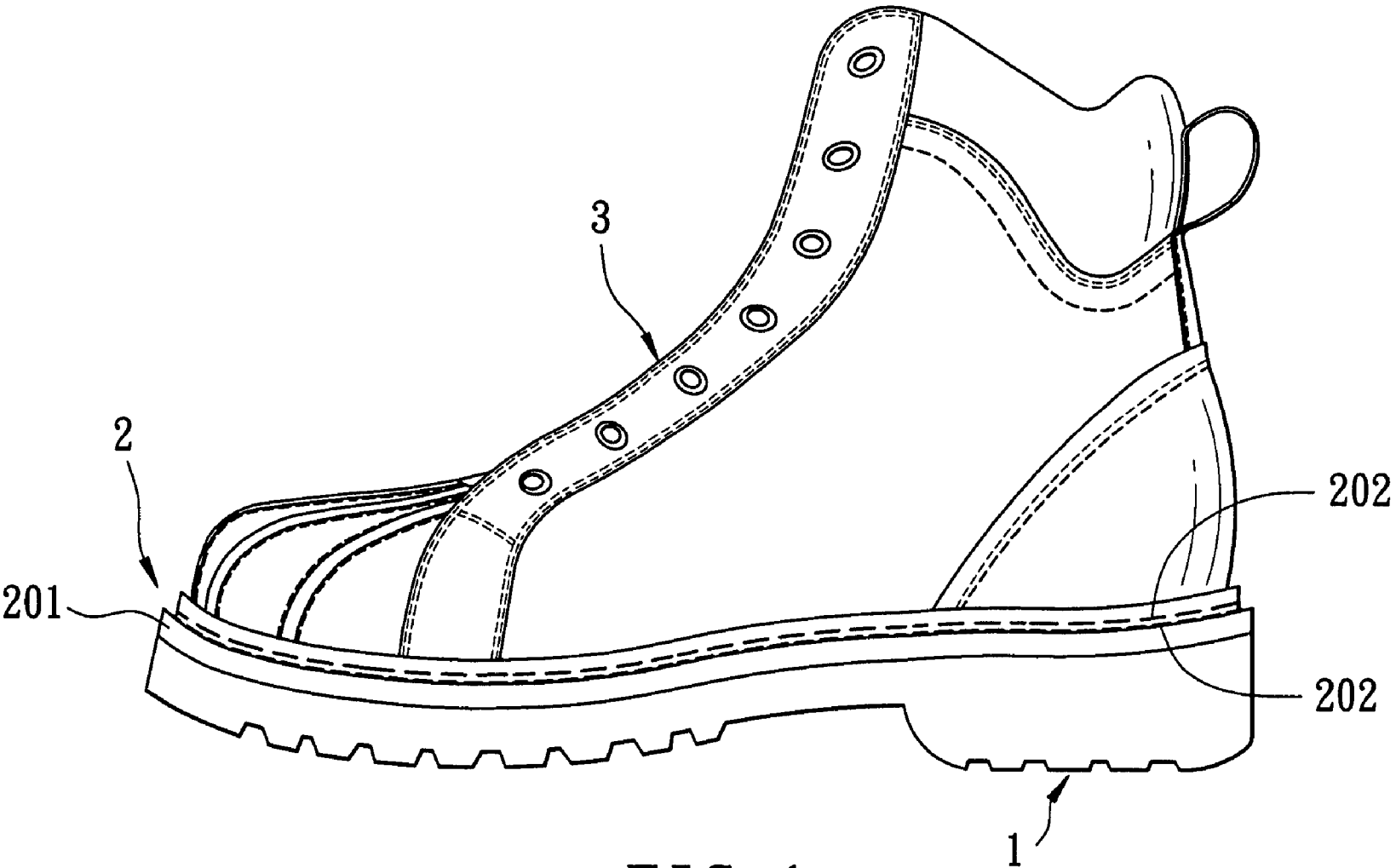
FIG. 1 PRIOR ART
FIG. 1 is a perspective view of a conventional shoe.
Figure 2:
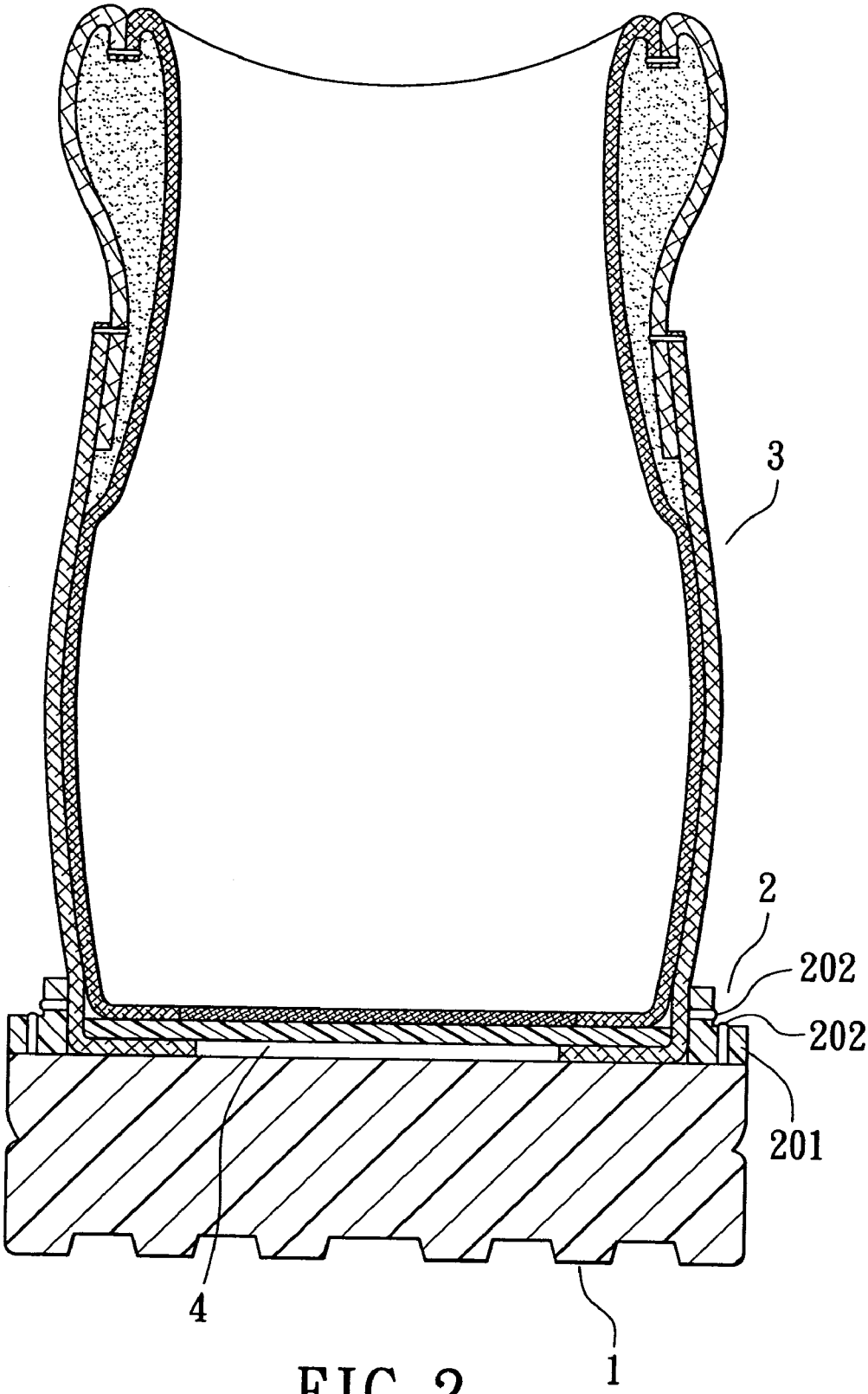
FIG. 2 PRIOR ART
FIG. 2 is a sectional view of the shoe of FIG. 1.
Figure 3:
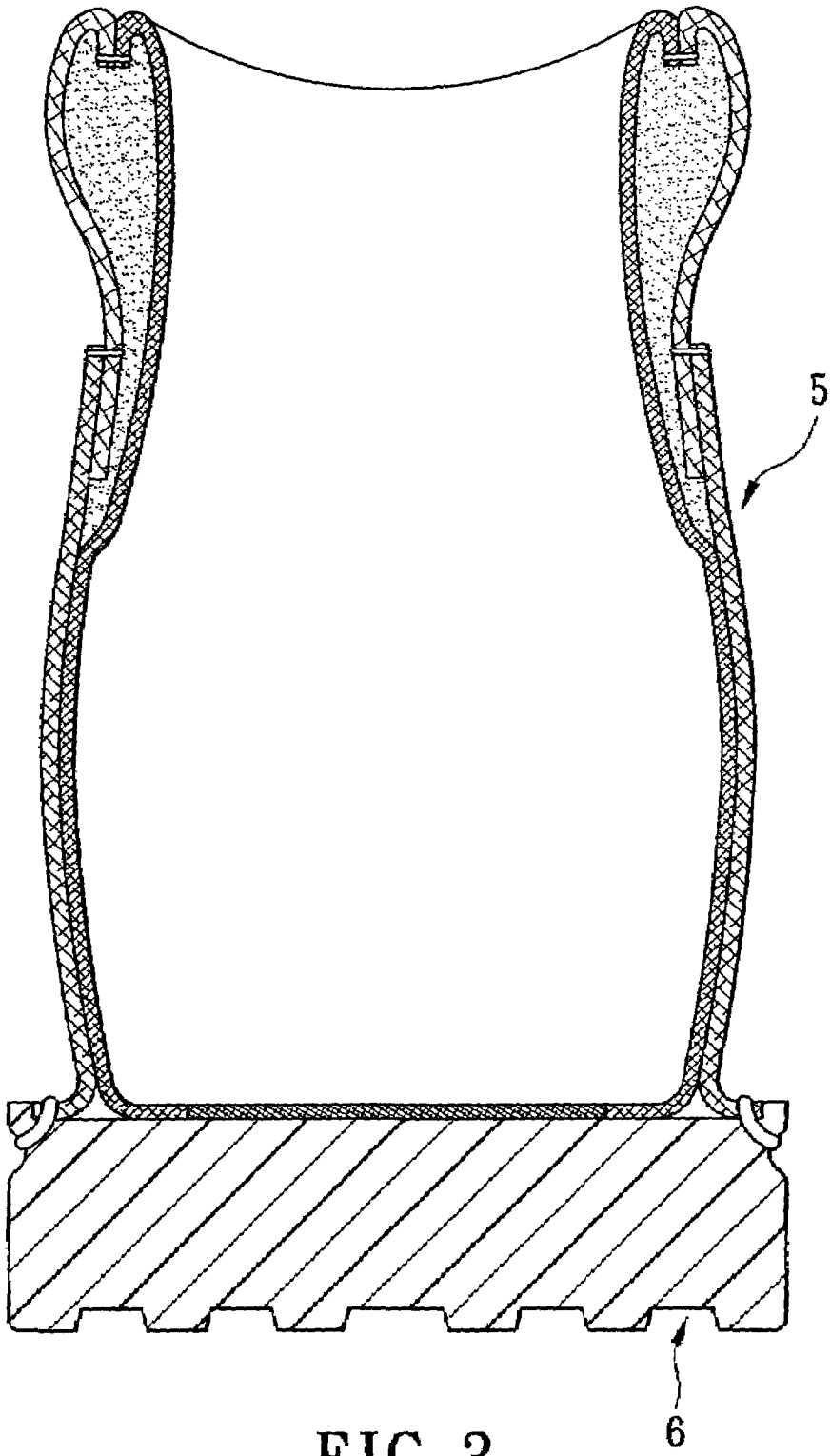
FIG. 3 PRIOR ART
FIG. 3 is a sectional view of another conventional shoe.

The present invention will be illustrated with reference to FIGS. 4 to 10, wherein like elements are represented by like reference numerals.

Figure 4:
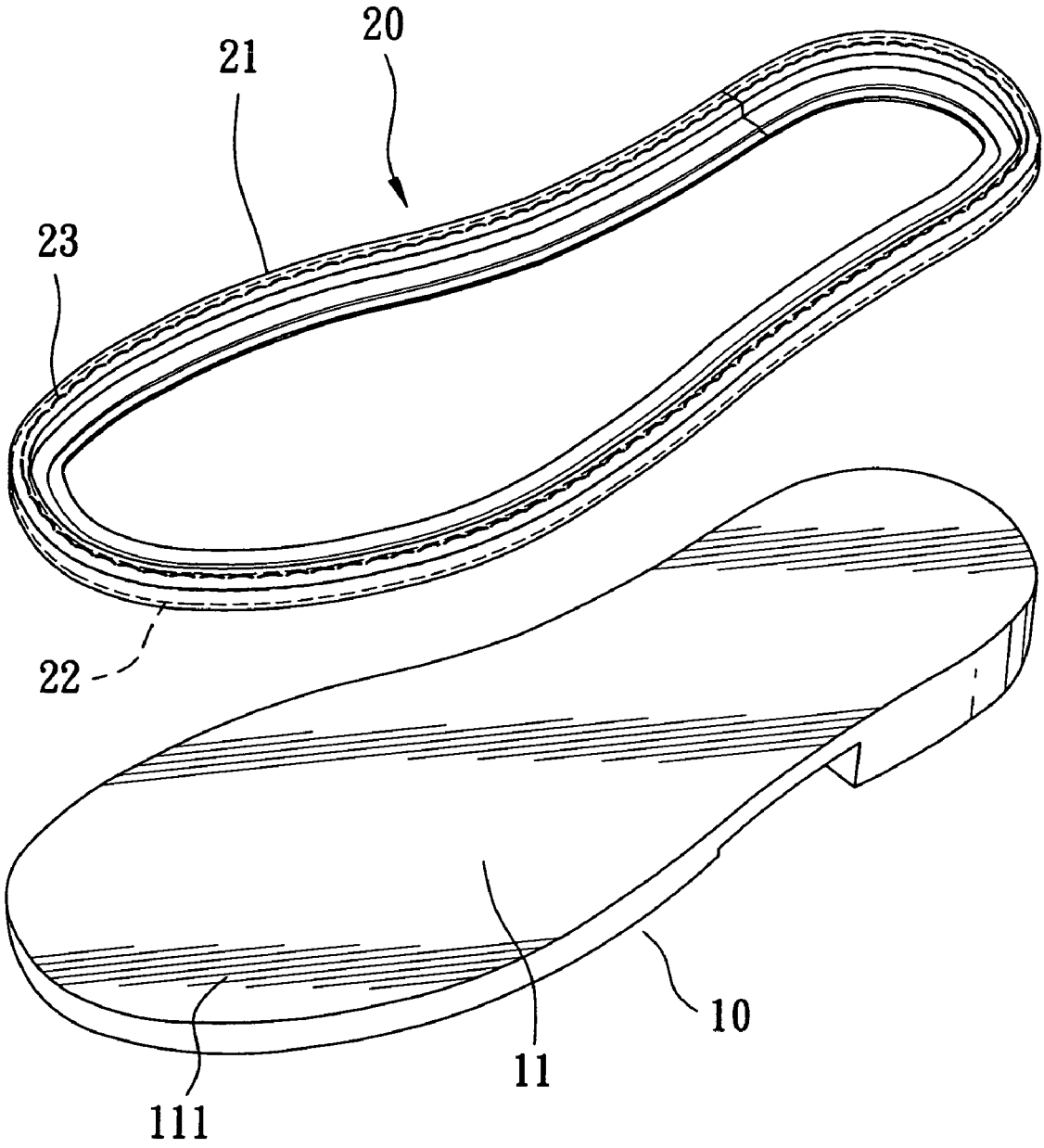
FIG. 4 is an exploded view showing an outsole and a welt member used in the first preferred embodiment of the present invention.
Figure 5:
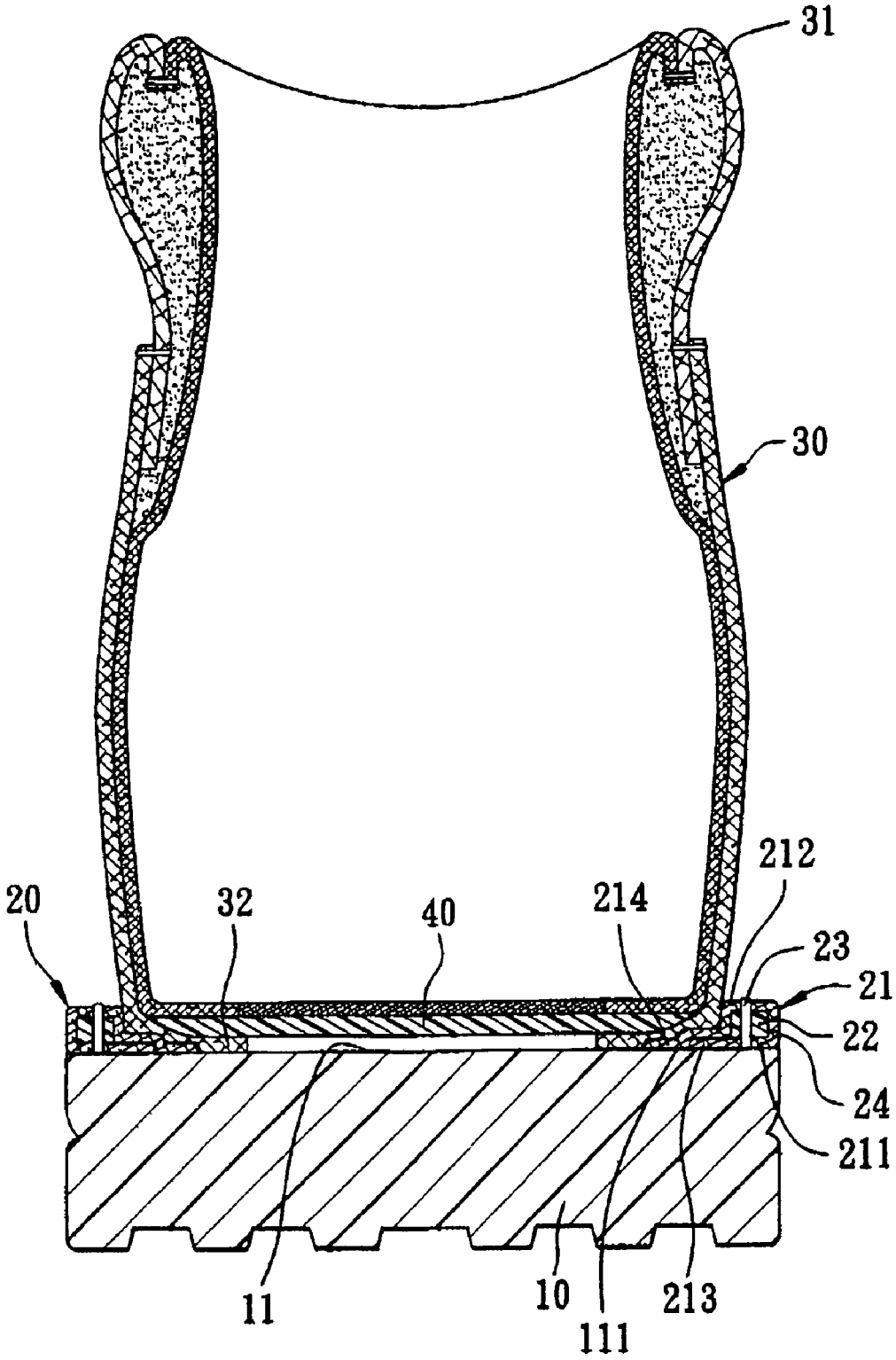
FIG. 5 is a sectional view of the first preferred embodiment of the present invention.

Referring to FIGS. 4 and 5, the first preferred embodiment of a shoe according to the present invention includes a shoe which has an outsole 10 with a top face 11 and a peripheral region 111. A welt member 20 is secured to the peripheral region 111 around an upper 30.

The welt member 20 is used as a false welt and includes a wrapping sheet 21, an interior strip 22 and a sewing line 23. The interior strip 22 is enclosed by the wrapping sheet 21. The interior strip 22 may be a molded or non-molded strip, and the wrapping sheet may be made of any suitable sheeting material. In this embodiment, the interior strip 22 is a molded strip which has a rectangular cross-section, and the wrapping sheet 21 is made of the same leathery material as the upper 30. The wrapping sheet 21 is folded to form a lower part 211, an upper part 212 extending over the lower part 211, and a fold part 24 interconnecting the lower and upper parts 211, 212.

The interior strip 22 is embraced by the lower and upper parts 211, 212 and the fold part 24. The lower and upper parts 211, 212 respectively have marginal parts 213, 214 which are opposite to the fold part 24 and which abut against each other. The marginal part 214 extends beyond the marginal part 213 of the lower part 211 so that the end of the marginal part 213 of the lower part 211 is entirely covered by the marginal part 214. Of course, the lower and upper marginal parts 213, 214 may be of the same width so that the upper part 212 has no portion extending beyond the marginal part 213 of the lower part 211. The sewing line 23 is formed through the wrapping sheet 21 and the interior strip 22 and extends along the full length of the welt member 20. In securing the welt member 20 to the peripheral region 111 of the outsole 10, the lower part 211 of the wrapping sheet 21 and the marginal part 214 are attached to the top face 11 of the outsole 10 through a gluing process. Alternately, a sewing process may be used to attach the welt member 20 to the outsole 10. The fold part 24 of the wrapping sheet 21 which bounds the interior strip 22 are located outwardly of the marginal parts 213 and 214.

The upper 30 has a top open end 31 and a bottom open end 32. The bottom open end 32 is lasted over an insole 40 and is glued to the top face 11 of the outsole 10 and the upper part 214 of the wrapping sheet 21.

The welt member 20 may be prepared by folding the wrapping sheet 21 about the interior strip 22 followed by sewing together the wrapping sheet 21 and the interior strip 22 with the sewing line 23 which extends along the full length of the wrapping sheet 21. Alternatively, the wrapping sheet 21 may be folded and sewn first to form a space which will in turn receive the interior strip 22. After the welt member 20 is prepared, it is glued to the peripheral region 111 on the top face 11 of the outsole 10. Then, the bottom open end 32 of the upper 30 which has been lasted over the insole 40 is glued to the top face 11 of the outsole 10 and the upper part 212 of the wrapping sheet 21. The marginal parts 213, 214 extend between the bottom open end 32 of the upper 30 and the top face 11 of the outsole 10.

Since the welt member 20 is made of a leathery material which is the same as that of the upper 30, the outer appearance of the shoe in this embodiment is harmonious and elegant. In addition, as the cross-section of the interior strip 22 may be in any shape other than a rectangle, the shape of the welt member 20 may be varied to match different shoe designs.

Figure 6:
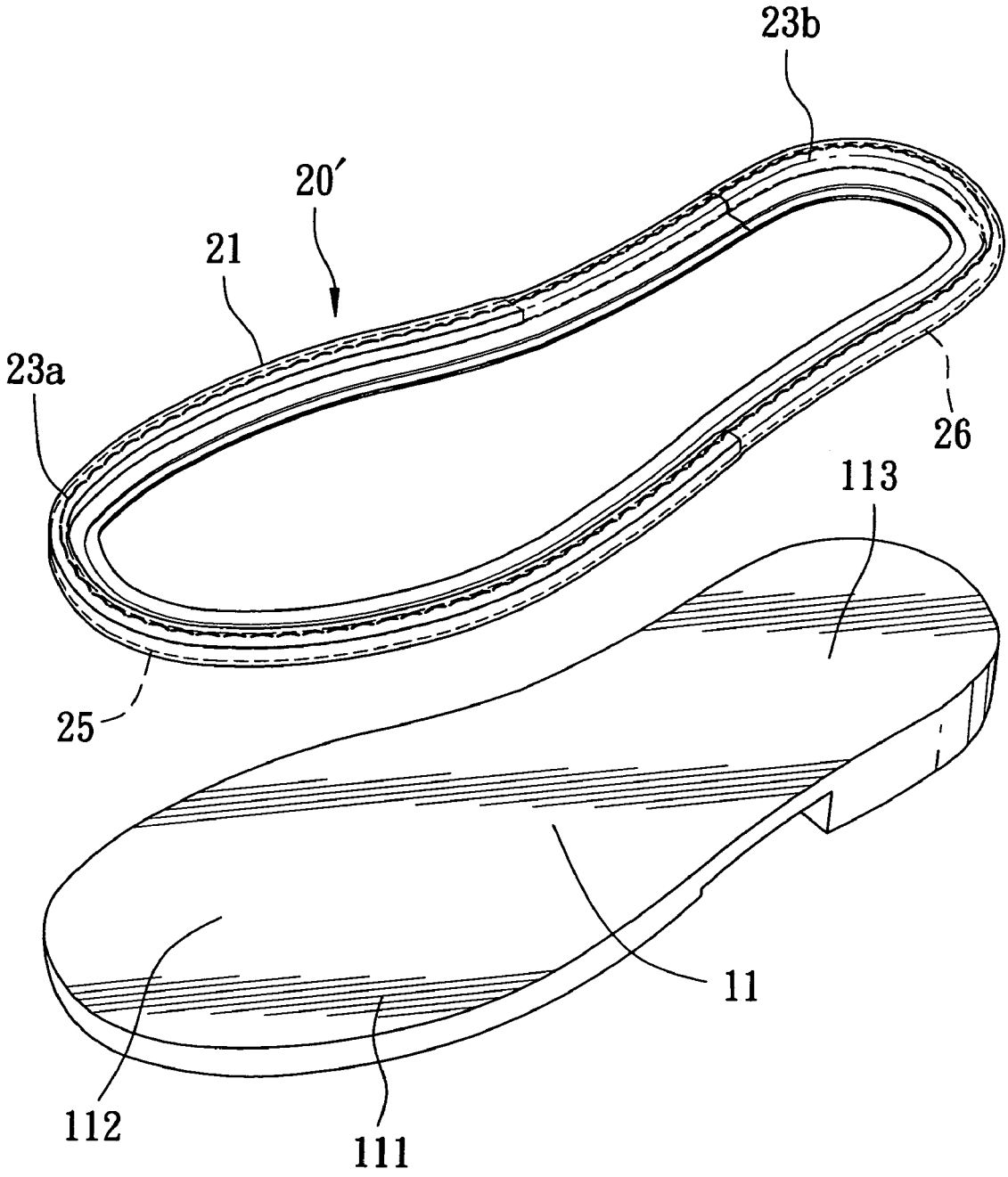
FIG. 6 is an exploded view showing an outsole and a welt member used in the second preferred embodiment of the present invention.
Figure 7:
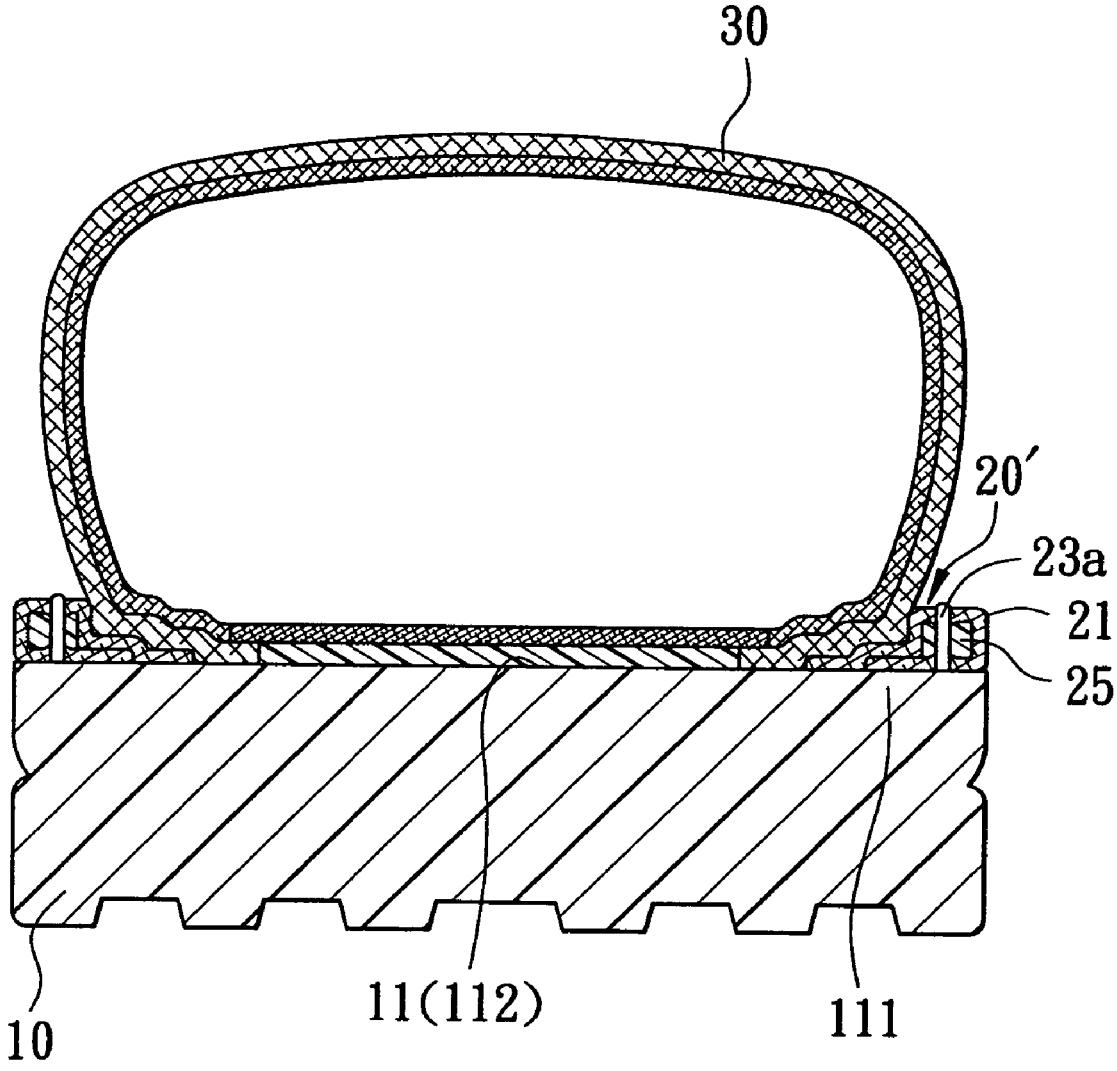
FIG. 7 is a sectional view of the second preferred embodiment.
Figure 8:
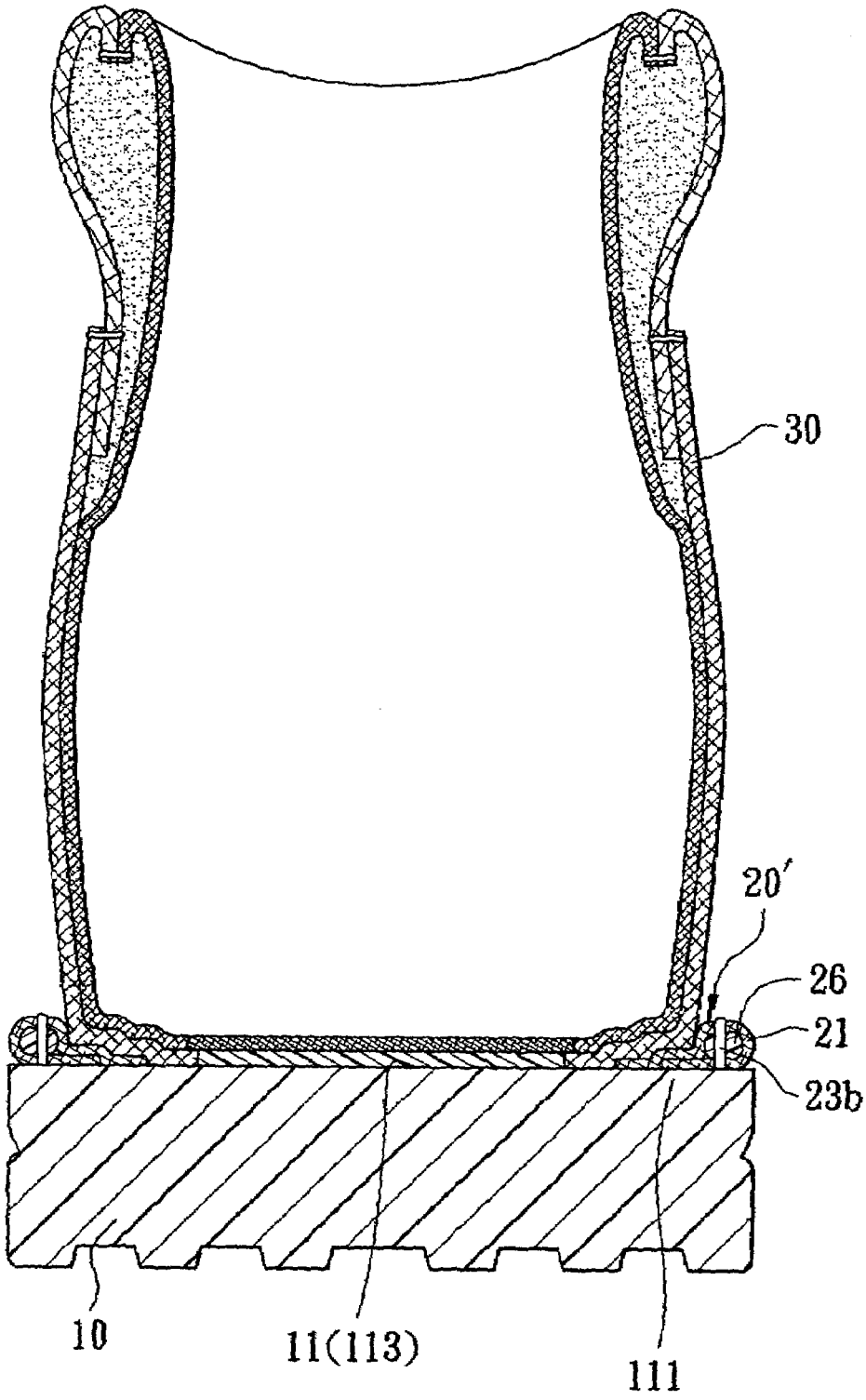
FIG. 8 is another sectional view of the second preferred embodiment of the present invention.

Referring to FIGS. 6, 7 and 8, a second preferred embodiment of the present invention is shown to have an outsole 10 and an upper 30 like the first embodiment. The top face 11 of the outsole 10 has a front region 112 and a rear heel region 113. The peripheral region 111 surrounds the front region 112 and the heel region 113. This embodiment utilizes a false welt member 20' which includes a wrapping sheet 21 enclosing an interior strip that is composed of a front strip section 25 and a rear strip section 26, and sewing lines 23*a* and 23*b*. The front and rear strip sections 25 and 26 are formed as separate pieces which have different cross-sections. Particularly, the front strip section 25 has a rectangular cross-section, whereas the rear strip section 26 has a circular cross-section. Furthermore, the rear strip section 26 has a stiffness greater than that of the front strip section 25. The front strip section 25 extends in the front region 112 of the outsole 10 along the peripheral region 111, whereas the rear strip section 26 extends in the rear heel region 113 along the peripheral region 111. Since the front and rear strip sections 25, 26 are different in their cross-sections, different shapes are presented by the welt member 20'. Moreover, as the welt member 20' has different degrees of stiffness or flexibility due to the front and rear strip sections 25 and 26, it can provide sufficient flexibility for the front region 112 of the outsole 10 while also maintaining sufficient stiffness for the rear heel region 113.

Figure 9:
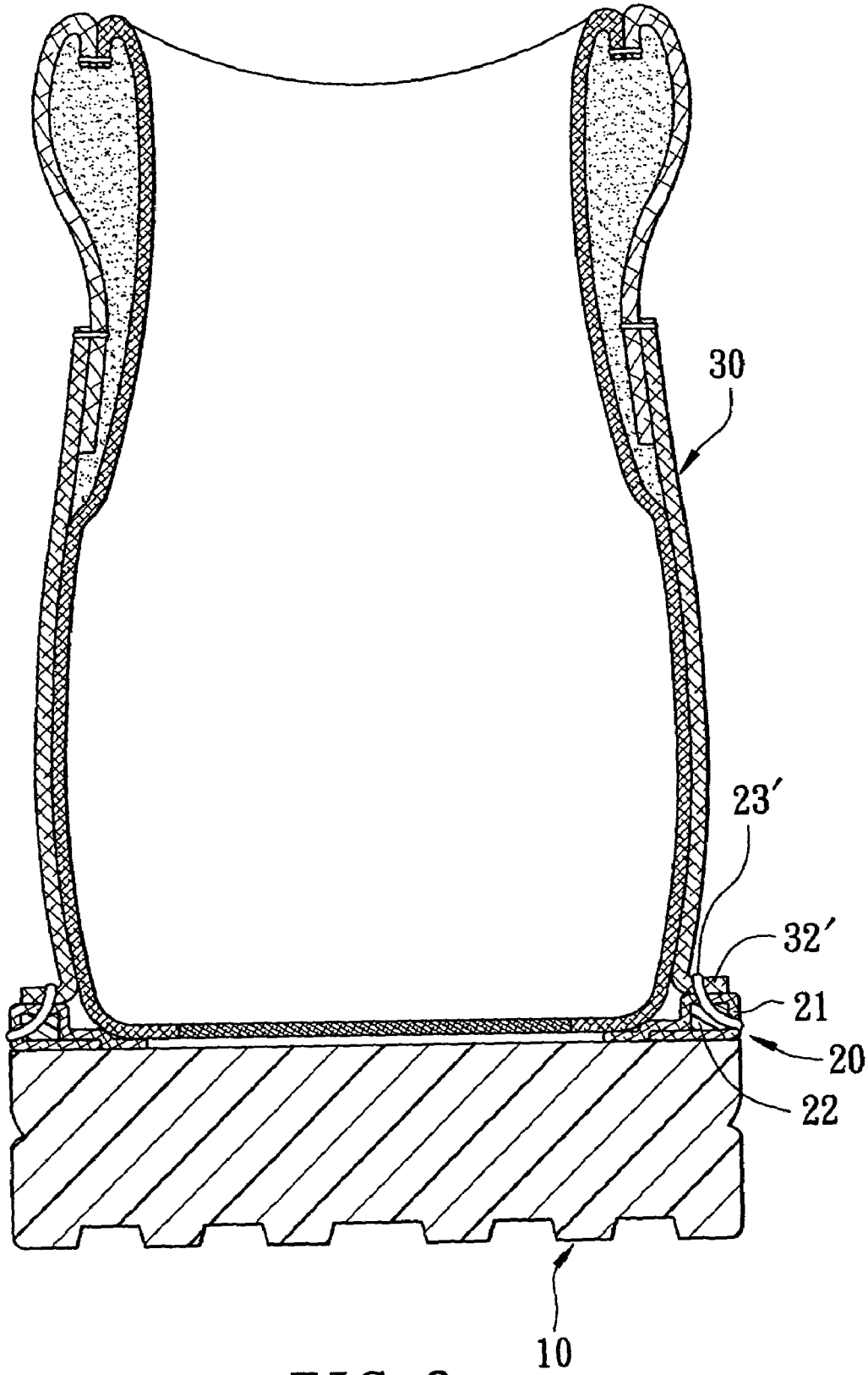
FIG. 9 is a sectional view of the third preferred embodiment of the present invention.

Referring to FIG. 9, a third preferred embodiment of the present invention is substantially similar to the first embodiment except that the upper 30 has an outwardly turned bottom open end 32' sewn to the welt member 20 through a sewing line 23'. Thus, the sewing line 23' extends through both of the bottom open end 32' and the welt member 20. Like a shoe of an Opanka construction method, the shoe of this embodiment does not require lasting the bottom open end 32' of the upper 30, thereby increasing the flexibility of the shoe. However, unlike the shoe of the Opanka construction method, the bottom end 32' of the upper 30 in this embodiment is sewn directly to the welt member 20 rather than to the outsole 10. Therefore, the material of the outsole 10 used in this embodiment need not be limited to PU which is heavy and hydrolyzable with water. In other words, the outsole 10 may be made of any other suitable material besides polyurethane.

Figure 10:
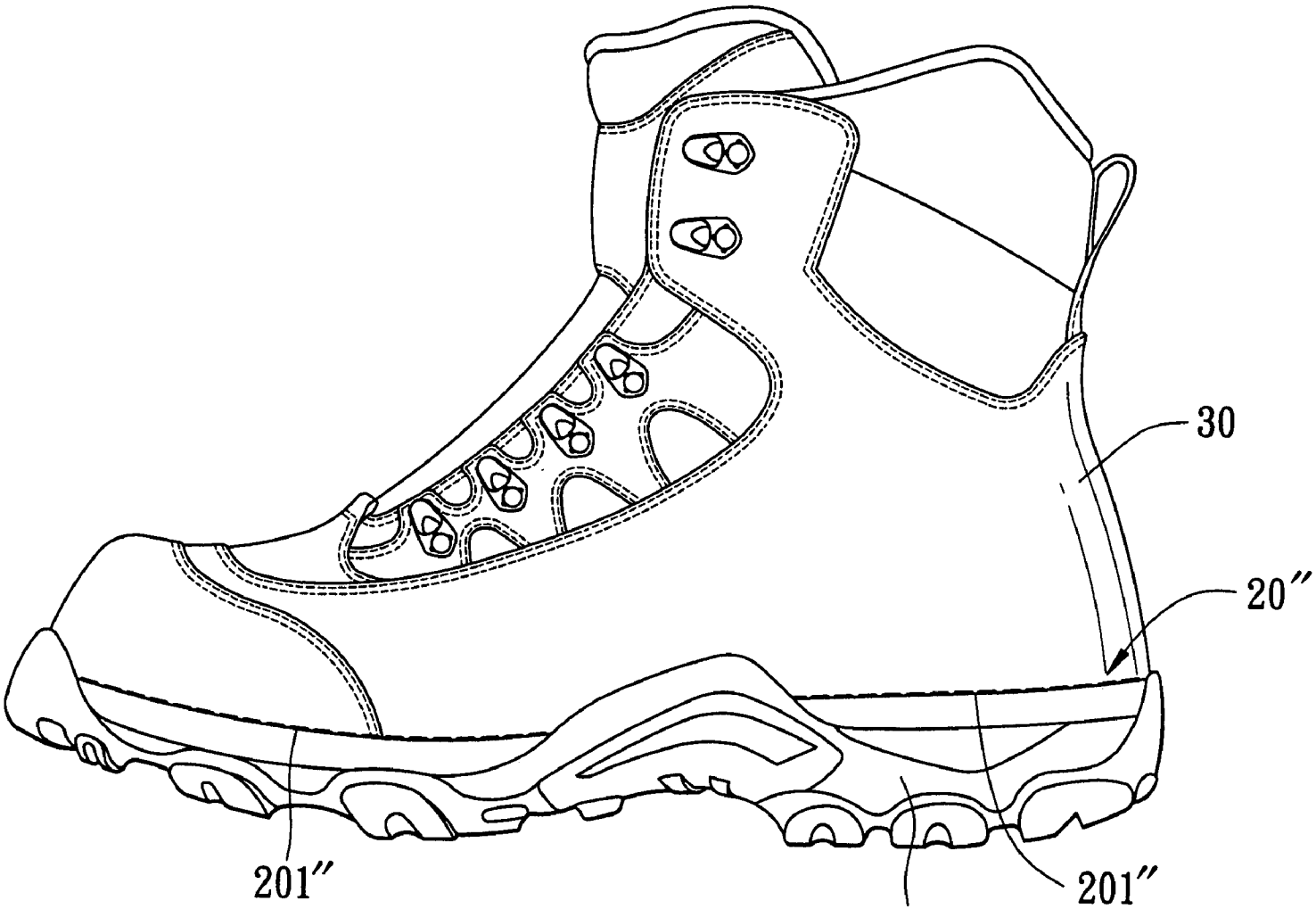
FIG. 10 is a side view of the fourth preferred embodiment of the present invention.

FIG. 10 shows the fourth preferred embodiment of the present invention which includes a welt member 20". The welt member 20" differs from the welt member 20 in that the welt member 20" is divided into four discrete welt sections 201" (only two welt sections 201" are shown in FIG. 10) which extend along the peripheral region 111 of the outsole 10.

While the present invention has been described in connection with what is considered the most practical and preferred embodiments, it is understood that this invention is not limited to the disclosed embodiments but is intended to cover various arrangements included within the spirit and scope of the broadest interpretation so as to encompass all such modifications and equivalent arrangements.

We claim:

1. A shoe comprising:

an outsole having a top face with a peripheral region;

a welt member extending along and secured to said peripheral region, said welt member including an interior strip, a wrapping sheet enclosing said interior strip, and a sewing line extending through said wrapping sheet, said wrapping sheet being folded to form a lower part, an upper part extending over said lower part, and a fold part interconnecting said lower and upper parts, said interior strip being embraced by said lower and upper parts and said fold part, said lower and upper parts respectively having marginal parts which are opposite to said fold part and which abut against each other; and an upper having a bottom open end, said bottom open end of said upper being secured to at least one of said top face of said outsole and said welt member;

wherein said marginal part of said upper part extends beyond said marginal part of said lower part and is bonded to said top face of said outsole.

2. The shoe as claimed in claim 1, wherein said marginal parts extend between said bottom open end and said top face of said outsole, said fold part extending outwardly of said marginal parts.

3. The shoe as claimed in claim 1, wherein said bottom open end of said upper is bonded to said upper part and said top face of said outsole.

4. The shoe as claimed in claim 1, wherein said outsole has a front region and a rear heel region, said interior strip being composed of a front strip section extending in said front region, and a rear strip section extending in said rear heel region.

5. The shoe as claimed in claim 4, wherein said front strip section has a stiffness less than that of said rear strip section.

6. The shoe as claimed in claim 4, wherein said front strip section has a cross-section different from that of said rear strip section.

7. The shoe as claimed in claim 1, wherein said bottom open end of said upper is turned outward and is sewn to said welt member.

8. The shoe as claimed in claim 1, wherein said wrapping sheet is made of a material which is the same as that of said upper.

9. The shoe as claimed in claim 1, wherein said interior strip is a molded strip.

10. The shoe as claimed in claim 1, wherein said welt member includes a plurality of discrete sections which extend along said peripheral region of said outsole.

11. A shoe comprising:

an outsole having a top face with a peripheral region;

a welt member extending along and secured to said peripheral region, said welt member including an interior strip, a wrapping sheet enclosing said interior strip, and a sewing line extending through said wrapping sheet, said wrapping sheet being folded to form a lower part, an upper part extending over said lower part, and a fold part interconnecting said lower and upper parts, said interior strip being embraced by said lower and upper parts and said fold part, said lower and upper parts respectively having marginal parts which are opposite to said fold part and which abut against each other;

an upper having a bottom open end, said bottom open end of said upper being secured to at least one of said top face of said outsole and said welt member, wherein said outsole has a front region and a rear heel region, said interior strip being composed of a front strip section extending in said front region, and a rear strip section extending in said rear heel region; and wherein said front strip section has a stiffness less than that of said rear strip section.

12. A shoe comprising:

an outsole having a top face with a peripheral region;

a welt member extending along and secured to said peripheral region, said welt member including an interior strip, a wrapping sheet enclosing said interior strip, and a sewing line extending through said wrapping sheet, said wrapping sheet being folded to form a lower part, an upper part extending over said lower part, and a fold part interconnecting said lower and upper parts, said interior strip being embraced by said lower and upper parts and said fold part, said lower and upper parts respectively having marginal parts which are opposite to said fold part and which abut against each other;

an upper having a bottom open end, said bottom open end of said upper being secured to at least one of said top face of said outsole and said welt member;

wherein said outsole has a front region and a rear heel region, said interior strip being composed of a front strip section extending in said front region, and a rear strip section extending in said rear heel region; and wherein said front strip section has a cross-section different from that of said rear strip section.

13. A shoe comprising:

an outsole having a top face with a peripheral region;

a welt member extending along and secured to said peripheral region, said welt member including an interior strip, a wrapping sheet enclosing said interior strip, and a sewing line extending through said wrapping sheet, said wrapping sheet being folded to form a lower part, an upper part extending over said lower part, and a fold part interconnecting said lower and upper parts, said interior strip being embraced by said lower and upper parts and said fold part, said lower and upper parts respectively having marginal parts which are opposite to said fold part and which abut against each other; and an upper having a bottom open end, said bottom open end of said upper being secured to at least one of said top face of said outsole and said welt member;

wherein said bottom open end of said upper is turned outward and is sewn to said welt member.

14. A shoe comprising:

an outsole having a top face with a peripheral region;

a welt member extending along and secured to said peripheral region, said welt member including an interior strip, a wrapping sheet enclosing said interior strip, and a sewing line extending through said wrapping sheet, said wrapping sheet being folded to form a lower part, an upper part extending over said lower part, and a fold part interconnecting said lower and upper parts, said interior strip being embraced by said lower and upper parts and said fold part, said lower and upper parts respectively having marginal parts which are opposite to said fold part and which abut against each other; and an upper having a bottom open end, said bottom open end of said upper being secured to at least one of said top face of said outsole and said welt member;

wherein said wrapping sheet is made of a material which is the same as that of said upper.

15. A shoe comprising:

an outsole having a top face with a peripheral region;

a welt member extending along and secured to said peripheral region, said welt member including an interior strip, a wrapping sheet enclosing said interior strip, and a sewing line extending through said wrapping sheet, said wrapping sheet being folded to form a lower part, an upper part extending over said lower part, and a fold part interconnecting said lower and upper parts, said interior strip being embraced by said lower and upper parts and said fold part, said lower and upper parts respectively having marginal parts which are opposite to said fold part and which abut against each other; and an upper having a bottom open end, said bottom open end of said upper being secured to at least one of said top face of said outsole and said welt member;

wherein said welt member includes a plurality of discrete sections which extend along said peripheral region of said outsole.

* * * * *